US005934489A

United States Patent [19]

Dusel et al.

[11] Patent Number: 5,934,489

[45] Date of Patent: Aug. 10, 1999

[54] DISPLAY RACK

[75] Inventors: David B. Dusel, Mohnton; Colin Duncan, Wyomissing, both of Pa.

[73] Assignee: DNZ Limited Partnership, Reading, Pa.

[21] Appl. No.: 08/974,486

[22] Filed: Nov. 19, 1997

[51] Int. Cl.[6] ..... A47F 5/08

[52] U.S. Cl. ..... 211/106; 211/46; 211/94.02; 211/106

[58] Field of Search ..... 211/106, 57.1, 211/59.1, 45, 46, 87.01, 94.02, 181.1, 85.31

[56] References Cited

U.S. PATENT DOCUMENTS

| | | | |
|---|---|---|---|
| D. 200,617 | 3/1965 | Smith | D80/10 |
| D. 341,283 | 11/1993 | Rosenthal | D6/566 |
| D. 351,523 | 10/1994 | Rosenthal | D6/566 |
| 691,368 | 1/1902 | East | 211/106 X |
| 1,076,392 | 10/1913 | Richardson | 211/106 X |
| 1,457,166 | 5/1923 | Hayes | 211/106 X |
| 3,481,481 | 12/1969 | Witek et al. | 211/49 |
| 3,501,015 | 3/1970 | Behles | 211/49 |
| 4,344,540 | 8/1982 | Marschak | 211/106 |
| 4,511,047 | 4/1985 | Elinsky | 211/90 |
| 4,516,682 | 5/1985 | Bell | 211/106 X |
| 4,616,753 | 10/1986 | Aslan | 211/57.1 |
| 4,775,054 | 10/1988 | Dixon | 211/57.1 |
| 5,526,941 | 6/1996 | Ford | 211/106 X |
| 5,690,238 | 11/1997 | Schmehr | 211/106 |

*Primary Examiner*—Blair M. Johnson
*Attorney, Agent, or Firm*—Synnestvedt & Lechner

[57] ABSTRACT

A rack for simultaneously displaying a multiplicity of different items for retail sale is disclosed. The rack is mounted on a vertical surface and is integrally formed from bent wire stock. The rack has a primary support of interconnected segments symmetrically disposed about a centerline in a stepped or zig-zag pattern to form a "V" shape. Stiffening elements made of wire stock are welded to the primary support between segments parallel to the vertical surface on opposite sides of the rack centerline. Display items are hung from segments disposed perpendicularly to the vertical surface. "Z" shaped segments engage mounting holes in the vertical surface, thereby attaching the rack to the surface. A finger projects from the primary support along the rack centerline, providing an additional item support segment.

13 Claims, 3 Drawing Sheets

FIG.1
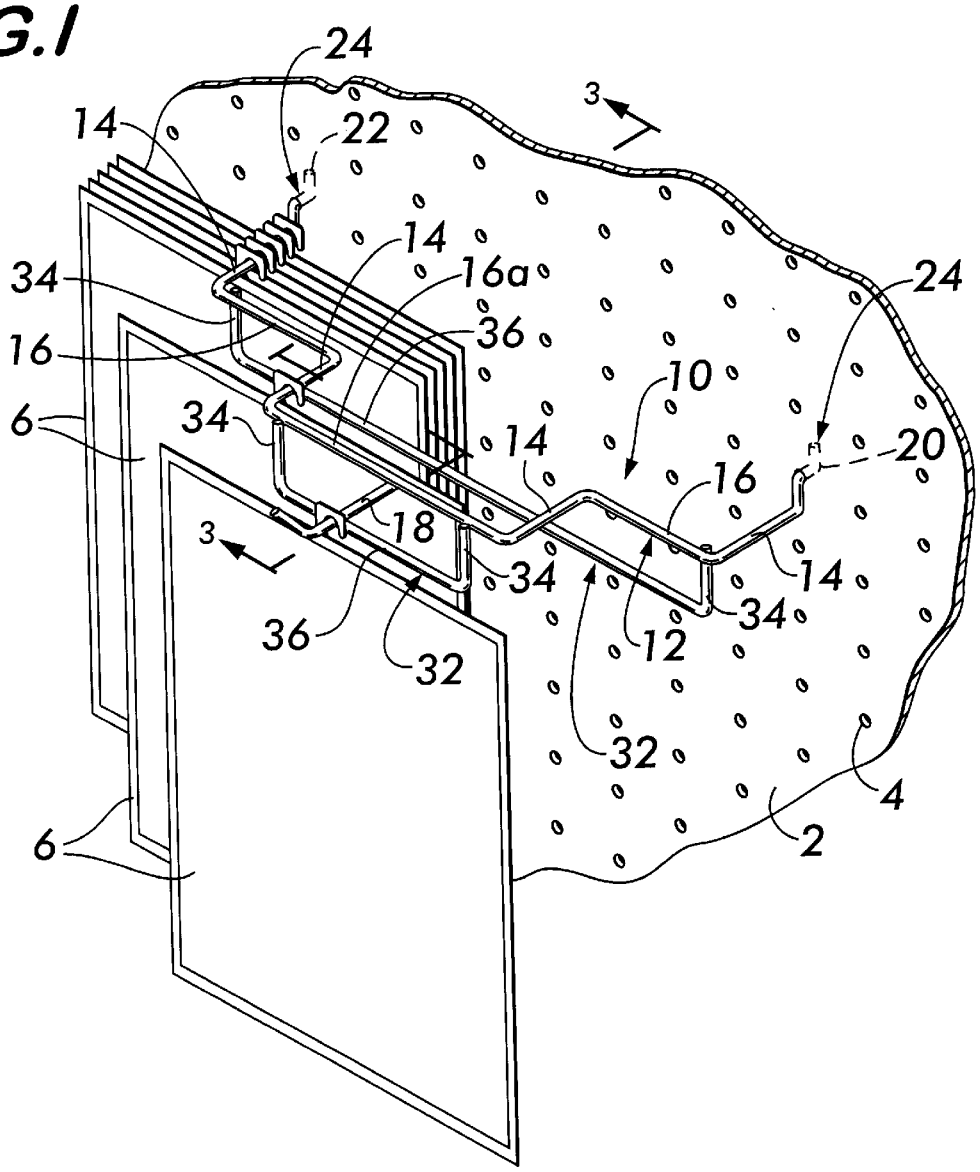
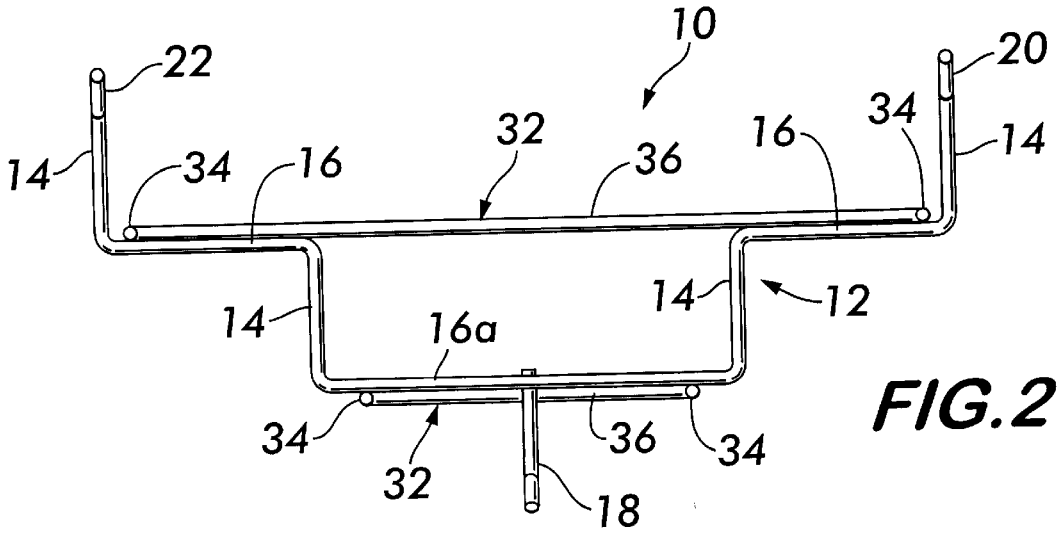
FIG.2

FIG. 3
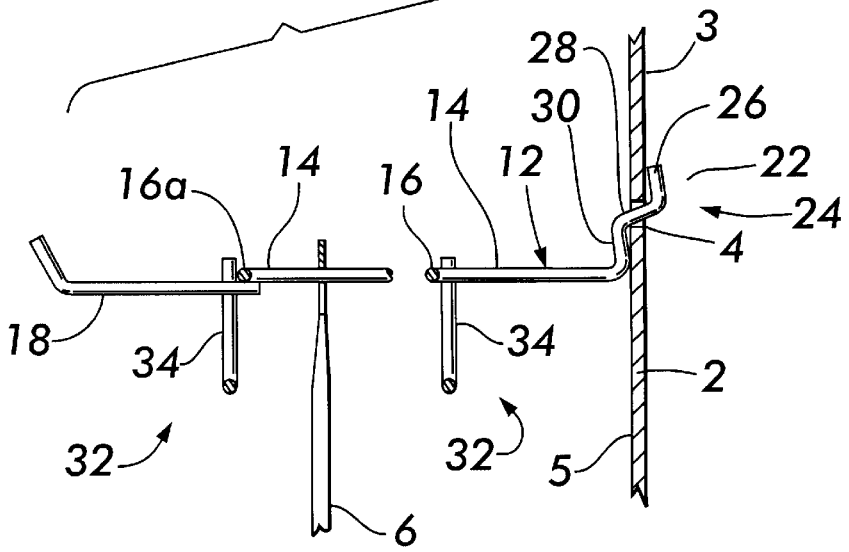
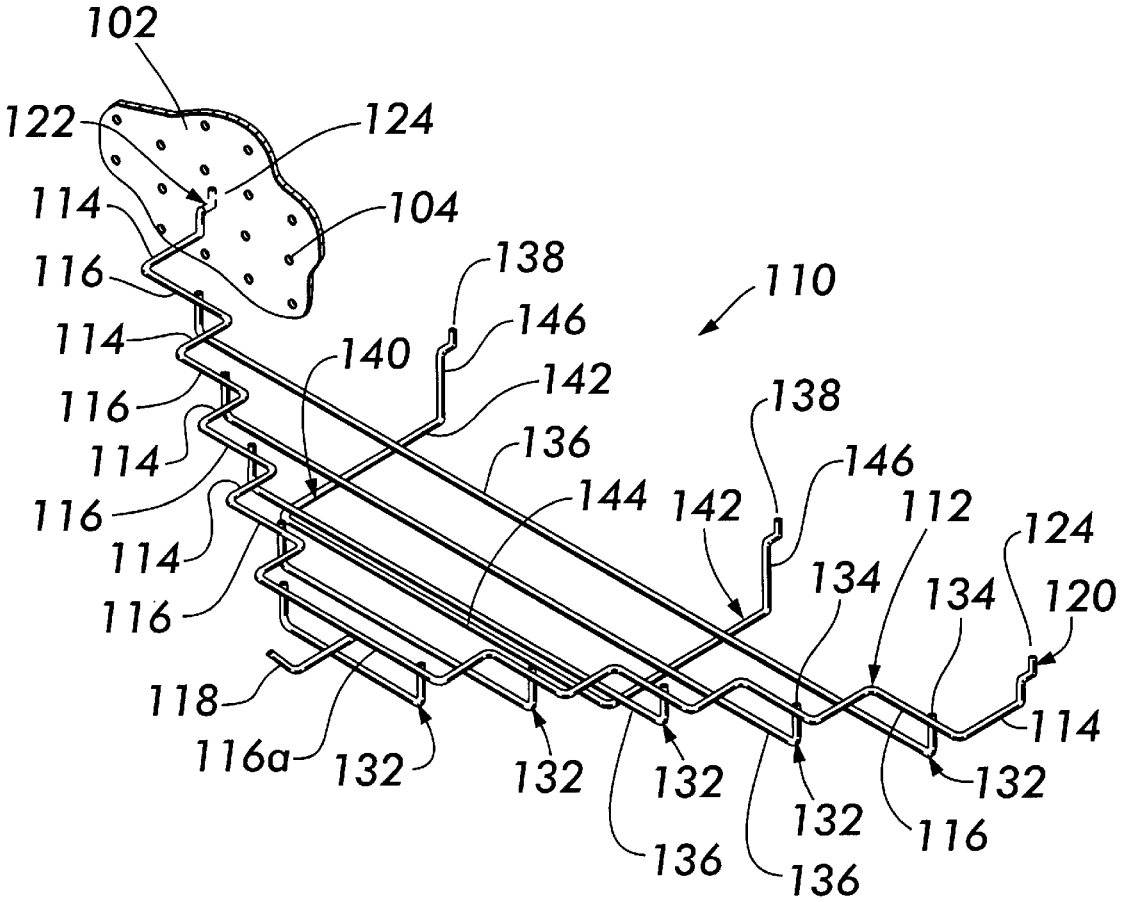
FIG. 4

DISPLAY RACK

FIELD OF THE INVENTION

This invention relates to racks for the display of items for retail sale.

BACKGROUND OF THE INVENTION

The manner in which items are displayed for retail sale can have a dramatic impact on the sales volume of the items. An attractive display providing convenient inspection of and access to a merchant's wares will measurably increase sales volume, while a poor display which fails to attract the attention of customers or fails to show the product to best advantage will have a detrimental effect on sales figures for the items. It is also in the merchant's interest to efficiently display the items, i.e., to use the least space of the limited space available to display the items to potential customers. Display space in a store is a limited and valuable resource which must be put to use efficiently and effectively to maximize and maintain a high level of sales.

Different items have different requirements for achieving efficient and effective display in a retail environment. Often the packaging of the items is designed to attract the attention of customers and induce a purchase, and an efficient and effective display means is one that incorporates the items' packaging as well as the other characteristics, such as shape, size and bulk, to display the maximum number of items to best advantage.

A particularly challenging design problem is presented by the display of various items having relatively flat packaging and a large surface area upon which an illustration of the product is displayed. Hobbyist's needle craft kits provide one example of such products, wherein the yarns and substrate of the kit are packaged in a flat transparent bag which has a cardboard insert with a color illustration of the completed needle craft kit. The illustration is intended to catch the attention of the customers and induce purchases, but to effectively display a multiplicity of different kits, each kit having a different illustration and each illustration being clearly visible normally requires a relatively large display area. Thus, there is a need for a means of displaying such items which conserves display space while showing off a maximum number of different items to best advantage.

SUMMARY AND OBJECTS OF THE INVENTION

This invention provides a rack for simultaneously displaying a multiplicity of items for retail sale in a minimum of space. The rack has a primary support which mounts onto a vertical panel structure having mounting apertures, such as a pegboard typically employed in retail display. The primary support projects outwardly from the panel surface forming a shallow "V" when viewed from above. The primary support is constructed from a plurality of interconnected segments arranged in a stepped or zig-zag pattern. Preferably, each segment is oriented at a right angle to its adjoining segment, although other angles are contemplated as well. The rack could be made of almost any material, but relatively stiff metal wire is preferred, thus, allowing the zig-zag shaped primary support to be conveniently fabricated from a continuous piece of the wire by alternately bending it to form predetermined segment lengths in the zig-zag pattern.

The ends of the primary support are preferably formed into a "Z" shaped wire segment typically used for pegboard mounting. The "Z" shape comprises a vertically oriented offset upper leg, a parallel lower leg and a transverse element which connects the offset leg to the lower leg of the "Z", the lower leg being integrally attached to the primary support via a right angle bend. When the primary support is mounted on the peg board, the upper leg is inserted into the aperture and impinges on the hidden or back surface of the board, the transverse element interfits within the aperture and the lower leg impinges on the front or visible surface of the board. Thus, the "Z" shaped wire fixes the primary support on the board yet allows the rack to be quickly and easily removed and relocated. Additional, "Z" shaped segments can be attached to the primary support in between the ends to provide intermediate mounting support points to the rack.

As noted above, the primary support is formed from a plurality of interconnected segments arranged in a stepped or zig-zag pattern. Preferably, the primary support forms a shallow "V" formed of the plurality of interconnected stepped segments symmetrically arranged on either side of a centerline through the apex of the "V". Thus, there is a group of segments which are generally parallel to the mounting surface and a group of segments which are oriented generally transversely or perpendicularly to the mounting surface. The perpendicular segments each provide a support from which to hang items for display. The length of the perpendicular segment determines how many items can be displayed from that particular segment. The length of the adjoining parallel segments determine the horizontal spacing between adjacent items hung from the rack. This arrangement is ideal for the display of flat packaging having illustrations thereon, allowing several items of the same type to be displayed on one perpendicular segment next to different items on another perpendicular segment. Due to the stepped nature of the zig-zag pattern, the various packages will overlap, and the degree of horizontal overlap is controlled by the length of the parallel segments. By lengthening or shortening the parallel segments, the illustrations on the packaging can be displayed for simultaneous viewing by prospective purchasers with little or no wasted space and no interference between packages, thus, allowing customers an unobstructed view of all the products.

It is preferable to mount a projecting finger along the rack centerline from the centermost parallel segment of the primary support. The projecting finger is oriented perpendicularly to the mounting surface and provides yet another support from which to hang items for display and sale. The finger is preferably made from the same type of wire forming the primary support and is welded to the primary support. Thus, the items displayed on the rack fan out in a shallow wedge shape similar to bowling pins viewed head on.

Racks of almost any size are possible, but with larger size racks having many segments holding a large quantity of product or racks intended to display relatively heavy products, the deflection or droop of the rack under the load becomes a concern. It is, therefore, advantageous to attach stiffening elements or reinforcing ribs to the primary support to limit rack deflection under load. Although many forms of stiffening element are possible, it is preferred to provide one or more elongated "U" shaped elements positioned beneath and attached to the primary support. The elongated stiffening elements are formed from the same type of wire as the primary support and have various lengths to span the distance between predetermined parallel segments on opposite sides of the rack centerline. The vertical legs of the "U" are welded to corresponding parallel segments and project downwardly from the primary support, stiffening the rack against bending by increasing the area moment of inertia of the rack structure. It is preferable to include a stiffening element between each pair of parallel segments on opposite sides of the rack centerline and one stiffening element on the foremost parallel segment supporting the projecting finger.

For larger racks, it is also preferable to have additional "Z" shaped segments located in between the ends of the rack to engage additional apertures in the mounting surface and provide intermediate support along the length of the rack. The additional "Z" segments are mounted on elongated wire segments which are welded to the stiffening elements and project from the stiffening elements to the mounting surface where the "Z" segments engage the mounting holes in the same manner, as described above. A large rack might, for example, have four aperture engaging "Z" segments, one at each end and the other two symmetrically placed about the rack centerline.

It is an object of the invention to provide a rack for simultaneously displaying a plurality of different items for retail sale.

It is another object of the invention to provide a means by which a plurality of items for retail sale can be simultaneously viewed without significant obstruction or interference.

It is yet another object of the invention to provide a means for maximizing the number of items displayed for retail sale while minimizing the amount of space required for displaying the items.

It is still another object of the invention to provide a simple, robust and unique structure for the display of items for retail sale.

These and other objects will become apparent from a consideration of the following drawings and detailed description of the preferred embodiment of the invention.

BRIEF DESCRIPTION OF THE DRAWINGS

FIG. 1 shows a perspective view of a display rack according to the invention mounted on a vertical surface and supporting a plurality of products for retail sale;

FIG. 2 shows a plan view of the rack illustrated in FIG. 1;

FIG. 3 shows a cross-sectional view of the rack illustrated in FIG. 1 taken along the line 3—3;

FIG. 4 shows an isometric view of a rack according to the invention, the rack being larger than that shown in FIG. 1.

DETAILED DESCRIPTION OF PREFERRED EMBODIMENT

Figure 5:
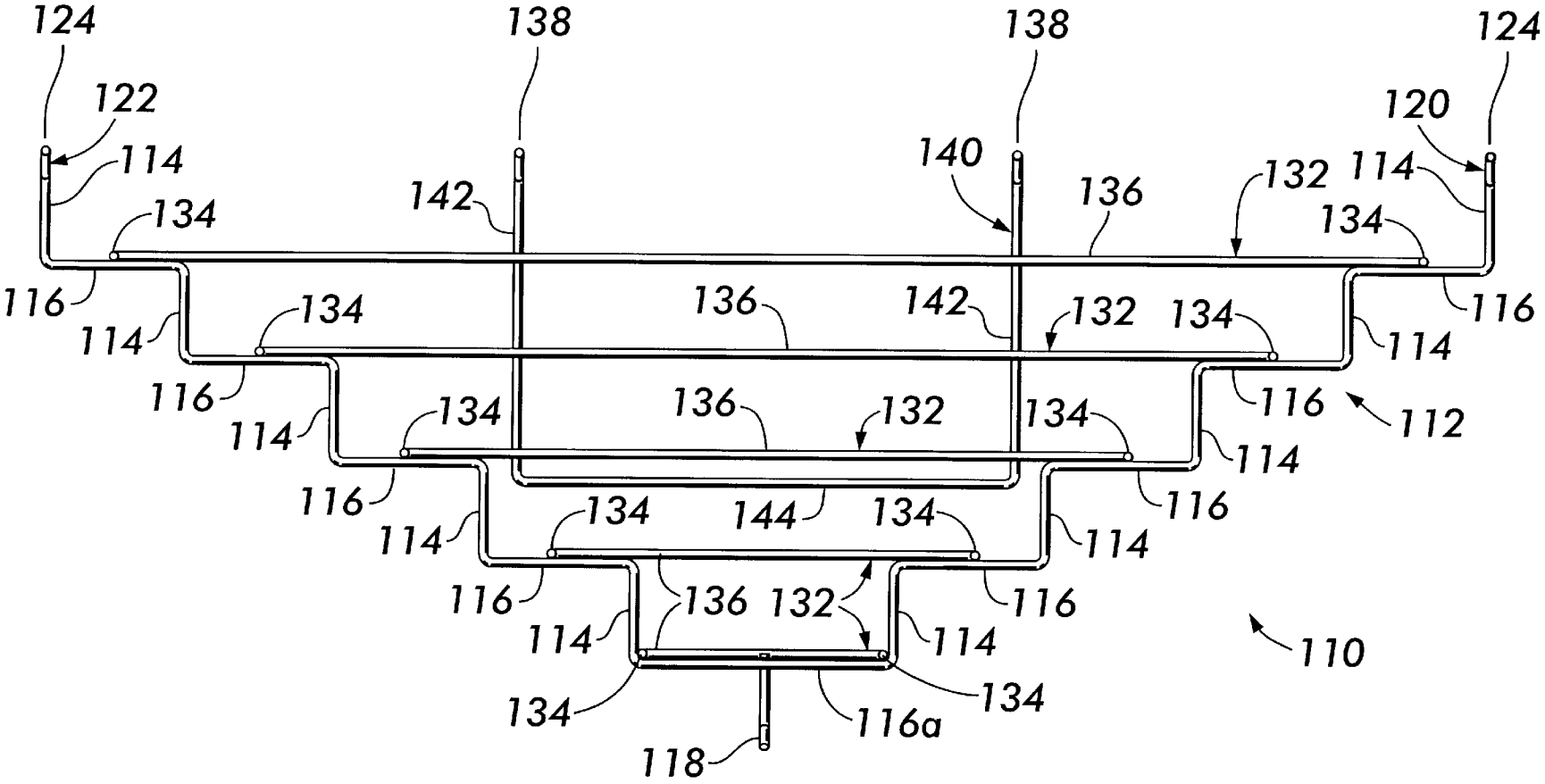
FIG. 5 shows a plan view of the rack illustrated in FIG. 4.

FIG. 1 shows the preferred embodiment of a display rack 10 mounted on a vertically oriented board 2 having apertures 4. Items 6 for retail sale are supported and displayed on rack 10 in an efficient and compact semi-overlapping manner, such that the items are arrayed for simultaneous display without occupying excessive display space.

As best seen in FIG. 2, rack 10 comprises a primary support 12 formed from a plurality of interconnected segments 14 and 16 arranged in a zig-zag pattern. Segments 14 are oriented transversely and preferably perpendicularly to the plane of board 2 and provide regions from which to suspend items 6, the length and number of segments 14 determining how many items can be suspended on rack 10. Segments 16 are oriented parallel to the plane of board 2 and provide connectivity between segments 14, the length of segments 16 controlling the horizontal spacing and hence, the degree of overlap of items 6 suspended from the rack. Preferably, primary support 12 is constructed from a single elongated piece of relatively stiff wire, the segments being bent at right angles relative to one another, although other angles are sometimes possible.

A finger 18 extends from the centermost segment 16*a*, finger 18 being arranged parallel to segments 14 and providing yet more space from which to suspend items 6 as seen in FIG. 1. Finger 18 is preferably constructed of the same wire as primary support 12 and is welded or otherwise affixed to centermost segment 16*a*.

The ends 20 and 22 of primary support 12 are spaced apart and formed into a "Z" shape 24 to engage apertures 4 in board 2 as illustrated in FIGS. 1 and 3. "Z" shape 24 comprises a substantially vertically oriented upper leg 26 connected to a transverse element 28 which, in turn, connects to another substantially vertically oriented lower leg 30. Lower leg 30 extends directly from primary support member 12 and "Z" shapes 24 are integrally formed from the same single piece of wire as forms the primary support. "Z" shapes 24 at ends 20 and 22 engage respective apertures 4 in board 2 to mount rack 10 to the board 2. A rack can be easily mounted on the board 2 by inserting upper legs 26 at each end 20 and 22 into respective apertures 4 in board 2 and further sliding ends 20 and 22 into the apertures so that transverse elements 28 interfit within the apertures. Upper legs 26 impinge on the back or hidden surface 3 of board 2, while lower leg 30 impinges on the front or visible surface 5 of board 2, thus, locking rack 10 into position on the board.

When loaded with display items 6, primary support 12 will tend to deflect under the force of gravity. As illustrated in FIGS. 1–3, stiffening elements 32 are provided to prevent excessive deflection of primary support 12. Stiffening elements 32 are preferably fabricated from the same wire as primary support 12 and are formed into a "U" shape comprising vertically oriented side legs 34 connected by a horizontal transverse piece 36. Stiffening elements 32 are attached to primary support 12 as by welding side legs 34 to respective segments 16 on opposite sides of rack 10 as best seen in FIG. 1. A stiffening element 32 is also typically welded to the centermost segment 16*a* for increased stiffening of this segment of the primary support 12. Side legs 34 act to separate transverse piece 36 from the primary support 12, thus, increasing the overall stiffness of the rack by increasing the area moment of inertia of the rack cross section, shown to advantage in FIG. 3. It is preferred that the transverse piece 36 of stiffening elements 32 be disposed below primary support 12.

FIGS. 4 and 5 show a rack 110 constructed in essentially the same manner as rack 10, but in a larger size, rack 110 having a longer primary support 112 with more interconnected segments 114 and 116 and more stiffening elements 132. Similar to stiffening elements 32, stiffening elements 132 are constructed of vertically oriented side legs 134 connected by a horizontal transverse piece 136, side legs 134 being welded between interconnected segments 116 on opposite sides of rack 110. The lengths of stiffening elements 132 naturally vary to span the distance between individual interconnected segments 116 to which they are welded.

Rack 110 also has a finger 118 extending from the centermost interconnected segment 116*a*, and the ends 120 and 122 of primary support 112 are spaced apart and have "Z" shapes 124 which engage board 102 in the same manner as the "Z" shapes 24 on rack 10. Rack 110 differs from rack 10 in that rack 110 has additional Z shapes 138 arranged symmetrically about the center of rack 110 inboard of primary support ends 120 and 122. These additional "Z" shapes are desirable on the larger racks to provide more support points from which to mount rack 110 onto the board 102. Larger support racks must support a heavier load than smaller racks, and more support points better distribute the point loads encountered where the "Z" shapes engage the board in order to avoid overloading the board and prevent a tear-out failure of the board at the points of "Z" shape engagement.

Additional "Z" shapes 138 engage apertures 104 in the same row as "Z" shapes 124. "Z" shapes 138 are connected to rack 110 on a "U"-shaped frame 140 comprising parallel spaced apart leg elements 142 which are arranged substantially perpendicular to and in a plane with the transverse elements 136 of stiffening elements 132. Leg elements 142 are welded to transverse pieces 136 of stiffening elements 132 and are connected to each other by cross piece 144 which generally runs parallel to transverse pieces 136. Extenders 146 project at a right angle to the plane of transverse pieces 136 from each leg element 142. A "Z" shape 138 is attached to the end of each extender 146. Preferably, frame 140 and additional "Z" shapes 138 are integrally formed from a single piece of wire similar to primary support 112.

In operation, racks 10 and 110 can be easily mounted on a peg board or other similar board typically used in the retail trade to display items for sale. Items, especially flat packaged goods as illustrated at 6 in FIG. 1, are displayed to best advantage by a rack according to the invention. Racks 10 or 110 allow a plurality of different items to be simultaneously visible, taking full advantage of any colorful, eye catching indicia or artwork displayed on the packaging to promote sales. Racks 10 and 110 are capable of supporting a relatively large number of items as well as a wide variety of items in a small space, thus, improving the efficiency of the display and using valuable store display space effectively. Racks, according to the invention, can be easily and readily repositioned on the peg board via the "Z" shape attachment means, thus, allowing for rapid reconfiguration of any display using a rack according to the invention. The racks are simple and inexpensive to manufacture and provide a robust display means adaptable to many different sizes and configurations. 2131

We claim:

1. A display rack mountable on a board having a plurality of apertures, said display rack for simultaneously displaying a multiplicity of items, said display rack comprising a plurality of interconnected segments arranged in pairs of interconnected first and second segments extending in a stepped pattern outwardly from said board, said plurality of pairs including a first and a second pair having a substantially Z-shaped extension extending from each said first segment of said first and second pairs, each said substantially Z-shaped extension having an upper leg, a transverse element, and a lower leg, said lower legs of each said extension extending substantially upwardly from said first segments to said transverse elements, said upper legs extending substantially upwardly from said transverse elements and being offset from said lower legs, said substantially Z-shaped extensions each engaging a respective aperture of said plurality of apertures in said board wherein said transverse elements each interfit within said respective aperture, said upper legs impinging upon a first surface of said board, said lower legs simultaneously impinging upon a second surface of said board opposite said first surface, thereby mounting said display rack to said board;

said first segments projecting outwardly from said board and the second segments angularly disposed with respect to the first segments and projecting generally toward each other, said plurality of pairs further including at least third and fourth pairs of segments, the first segments of said third and fourth pairs being joined respectively to the second segments of said first and second pairs of segments, the second segments of the third and fourth pairs projecting towards one another, and the first segments of each of said plurality of pairs comprising supports for support of said items, said display rack further comprising a plurality of elongated stiffening elements arranged substantially parallel to said board in a vertically spaced apart relationship from said pairs of interconnected segments, each stiffening element of said plurality having a different predetermined length, each of said stiffening elements being connected between a different pair of interconnected segments from another of said plurality of stiffening elements, thereby stiffening said display rack.

2. A display rack according to claim 1, wherein said first segments are oriented substantially at right angles relative to said second segments.

3. A display rack according to claim 1, wherein said pairs of interconnected segments are integrally formed from a single elongated member.

4. A display rack according to claim 1, wherein said pairs of interconnected segments are integrally formed from a single piece of wire.

5. A display rack according to claim 1, wherein said stiffening elements are arranged below said pairs of interconnected segments.

6. A display rack according to claim 1, further comprising a finger extending from one of said segments, said finger being oriented substantially perpendicular to said board and providing an additional support upon which to hang said items for display.

7. A display rack according to claim 6, wherein said finger is positioned midway between said first and second pairs.

8. A rack for displaying a multiplicity of items, said rack being mountable on a vertical surface having at least two mounting apertures, said rack comprising a primary support from which said items are hung, said primary support being formed from wire stock bent into a plurality of segments having a right angle between each said segment thereby forming a stepped pattern extending outwardly from said surface, said rack having a centerline oriented normal to said vertical surface, said segments being arranged in symmetric, corresponding pairs about said centerline forming a V shape, said primary support having aperture engaging means at each end thereof arranged symmetrically about said centerline, said aperture engaging means each being interengagable with one of said mounting apertures for mounting said rack on to said surface;

said rack further comprising:

a reinforcing rib comprising a pair of side legs, each of said side legs having first and second ends; and an elongated transverse connecting piece, said side legs being arranged in a parallel, spaced-apart relationship and having said first ends affixed to said transverse connecting piece at each end thereof thereby forming a U shape, said second ends of said side legs each being attached to a respective segment of said plurality of segments, thereby stiffening said primary support.

9. A rack according to claim 8, further comprising a finger attached to said primary support and projecting horizontally therefrom along said centerline, said finger being formed from wire stock and providing an additional length from which to hang said items.

10. A rack according to claim 9, wherein said rib and said finger are attached to said primary support by welding.

11. A rack according to claim 8, wherein said rib is attached between a predetermined corresponding pair of segments of said plurality of segments.

12. A rack according to claim 8, further comprising a plurality of ribs, each rib of said plurality being attached between a respective corresponding pair of said plurality of segments distinct from any other rib.

13. A display rack mountable on a board having a plurality of apertures, said display rack for simultaneously displaying a multiplicity of items, said display rack comprising a plurality of interconnected segments arranged in pairs of interconnected first and second segments extending in a stepped pattern outwardly from said board, said plurality of pairs including a first and a second pair having a Z-shaped extension extending from each said first segment of said first and second pairs, each said Z-shaped extension having an upper leg, a transverse element, and a lower leg, said lower legs of each said extension extending substantially upwardly from said first segments to said transverse elements, said upper legs extending substantially upwardly from said transverse elements and being offset from said lower legs, said Z-shaped extensions each engaging a respective aperture of said plurality of apertures in said board wherein said transverse elements each interfit within said respective aperture, said upper legs impinging upon a first surface of said board, said lower legs simultaneously impinging upon a second surface of said board opposite said first surface, thereby mounting said display rack to said board;

said first segments projecting outwardly from said board and the second segments angularly disposed with respect to the first segments and projecting generally toward each other, said plurality of pairs further including at least third and fourth pairs of segments, the first segments of said third and fourth pairs being joined respectively to the second segments of said first and second pairs of segments, the second segments of the third and fourth pairs projecting towards one another, and the first segments of each of said plurality of pairs comprising supports for support of said items, said display rack further comprising an elongated stiffening element arranged substantially parallel to said board in a vertically spaced apart relationship from said pairs of interconnected segments, said stiffening element comprising a U-shaped wire having vertically oriented side legs connected by a horizontal transverse piece, the ends of said side legs being connected between two of said segments thereby stiffening said display rack.

* * * * *